US008715483B1

(12) United States Patent
Maccagni et al.

(10) Patent No.: US 8,715,483 B1
(45) Date of Patent: May 6, 2014

(54) PROCESS FOR THE RECOVERY OF LEAD FROM LEAD-BEARING MATERIALS

(75) Inventors: Massimo Giuseppe Maccagni, Sesto San Giovanni (IT); Jonathan Hylkjier Nielson, Rolla, MO (US); William Leonard Lane, Viburnum, MO (US); David Michael Olkkonen, Viburnum, MO (US)

(73) Assignee: Metals Technology Development Company, LLC, St. Louis, MO (US)

( * ) Notice: Subject to any disclaimer, the term of this patent is extended or adjusted under 35 U.S.C. 154(b) by 192 days.

(21) Appl. No.: 13/444,706

(22) Filed: Apr. 11, 2012

(51) Int. Cl.
*C25C 1/18* (2006.01)
*C25C 7/06* (2006.01)

(52) U.S. Cl.
CPC .... *C25C 1/18* (2013.01); *C25C 7/06* (2013.01)
USPC ..... 205/600; 205/599; 204/236

(58) Field of Classification Search
USPC ..... 205/600; 204/236
See application file for complete search history.

(56) References Cited

U.S. PATENT DOCUMENTS 3,628,917 A * 12/1971 Nault ..... 422/252
4,181,588 A * 1/1980 Wong et al. ..... 205/600
5,039,337 A 8/1991 Olper et al. ..... 75/725
5,217,751 A * 6/1993 King et al. ..... 205/85
5,441,609 A * 8/1995 Olper ..... 205/599
5,630,931 A * 5/1997 Manequini ..... 205/600
6,203,769 B1 * 3/2001 Zoppi ..... 423/37
6,340,423 B1 * 1/2002 Duyvesteyn ..... 205/600
2008/0025908 A1 * 1/2008 Chu et al. ..... 423/463
2012/0164342 A1 * 6/2012 Hakiri ..... 427/437

OTHER PUBLICATIONS

Ojebuoboh et al, "Refining Primary Lead by Granulation-Leaching-Electrowinning", JOM, vol. 55, Issue 4, pp. 19-23, Apr. 2003.*

* cited by examiner

*Primary Examiner* — Harry D Wilkins, III
(74) *Attorney, Agent, or Firm* — Harness, Dickey & Pierce, P.L.C.

(57) ABSTRACT

A system for recovering lead from lead-bearing materials by circulating an aqueous solution of ferric fluoroborate in fluoroboric acid through a leaching vessel to leach lead from the lead-bearing material and an electrolytic cell for recovering the lead includes a cooler for cooling at least a portion of the circulating solution sufficiently to precipitate alkali salts and alkali-earth salts, and a filter for removing the precipitated salts from the solution. A process for recovering lead from lead-bearing materials by leaching the lead from the lead-bearing material with a solution of ferric fluoroborate in fluoroboric acid and recovering the lead from the solution includes cooling at least a portion of the circulating solution sufficiently to precipitate alkali salts and alkali-earth salts, and filtering the salts from the solution.

26 Claims, 1 Drawing Sheet

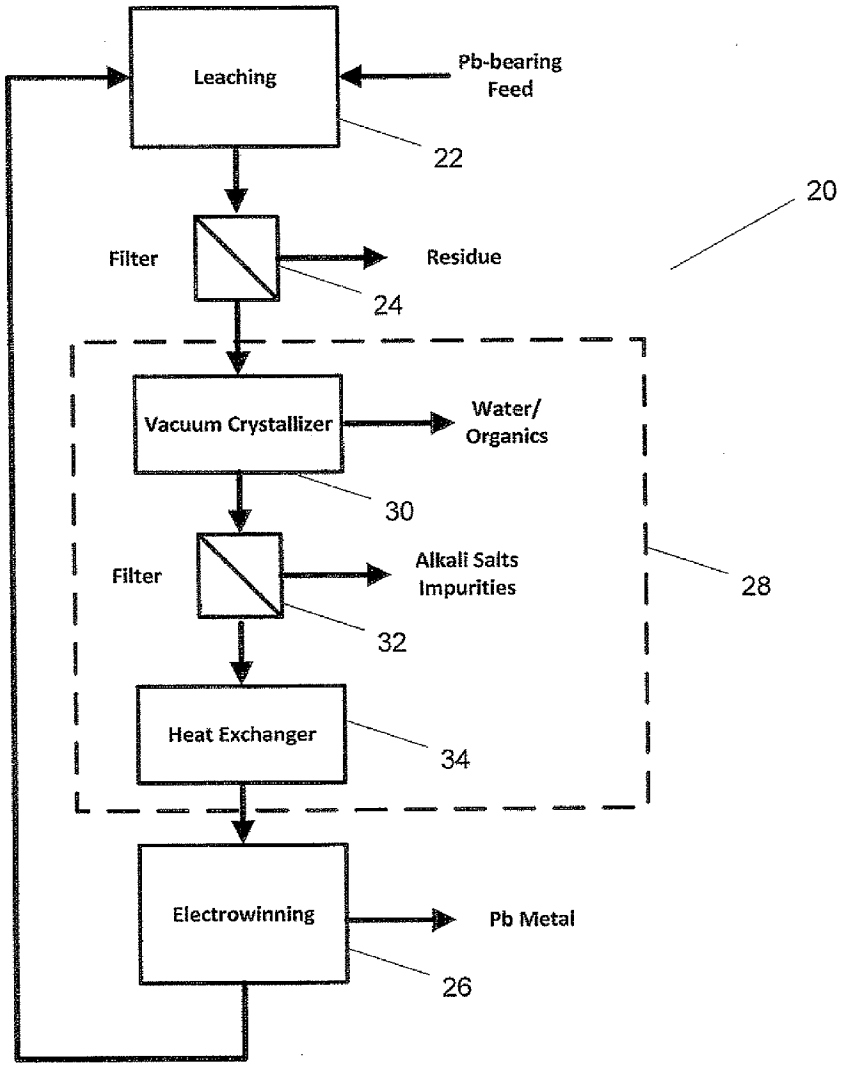
20
Pb-bearing Feed
22
Leaching
Filter
Residue
24
28
Vacuum Crystallizer
Water/ Organics
30
Filter
Alkali Salts Impurities
32
Heat Exchanger
34
Electrowinning
Pb Metal
26

PROCESS FOR THE RECOVERY OF LEAD FROM LEAD-BEARING MATERIALS

FIELD

The present disclosure relates to the hydrometallurgical recovery of lead from lead-bearing materials, and in particular to improvements in continuous processes for the hydrometallurgical recovery of lead.

BACKGROUND

This section provides background information related to the present disclosure which is not necessarily prior art.

Engitec SA has developed a hydrometallurgical process for the recovery of lead from lead-bearing materials, such as galena (lead sulfide) or other lead ores. One embodiment of this process, known commercially as the Flubor Process, is disclosed in U.S. Pat. No. 5,039,337, issued Aug. 12, 1991, entitled Process for Producing Electrolytic Lead and Elemental Sulfur from Galena, the entire disclosure of which is incorporated herein by reference.

Generally, the Flubor Process involves leaching galena with an acidic aqueous solution of ferric fluoroborate to form ferrous fluoroborate, lead fluoroborate, and elemental sulfur according to the reaction:

$$2Fe(BF_4)_3+PbS \rightarrow 2Fe(BF_4)_2+Pb(BF_4)_2+S$$

the remaining solid residue composed of elemental sulfur and gangue is removed. The solution of ferrous fluoroborate and lead fluoroborate circulates to a diaphragm electrolytic cell, where pure lead is deposited at the cathode while at the anode ferrous ion is oxidized to ferric ion. The solution of ferric fluoroborate regenerated at the anode is reused in the leaching step. By operating under suitable conditions, lead can be selectively dissolved and separated from the other metals, small amounts of which are contained in galena together with said lead. Sulfur produced by the reaction can be separated from the gangue by extraction with a solvent, or by flotation.

The advantages of the Flubor Process include the reduced energy consumption and reduction of slag and $SO_2$ emissions that are typical by-products of pyrometallurgical recovery processes. A pilot plant producing 100 pounds of lead metal has operated for years without incident. However when scaled up, a demonstration plant capable of producing 2000 tons of lead per year, the system inexplicably experienced precipitation of other solids in the system, and particularly in the electrolytic cells, which plugged the system, and interfered with the deposition of lead in the electrolytic cells.

SUMMARY

This section provides a general summary of the disclosure, and is not a comprehensive disclosure of its full scope or all of its features.

Embodiments of the present invention provide a system and method for the recovery of lead using circulating fluoroboric acid solution in which alkali salts (in particular potassium, magnesium, calcium, and other salts) are removed from the circulating fluoroboric acid solution to reduce interruption of the system and interference with the recovery of lead. Some of the organic materials introduced in the processing of the lead-bearing materials can be removed as well.

In accordance with one embodiment of this invention, a continuous system for recovering lead from lead-bearing materials is provided, in which an aqueous solution of ferric fluoroborate in fluoroboric acid is circulated through a leaching vessel to leach lead from lead-bearing material and an electrolytic cell, in which lead is recovered from the solution. A cooler, for example an evaporative cooler, is provided for cooling at least a portion of the circulating solution sufficiently to precipitate alkali salts, and a filter for removing precipitated alkali salts from the solution.

In accordance with another embodiment of this invention, a continuous process is provided for recovering lead from lead-bearing materials, in which an aqueous solution of ferric fluoroborate in fluoroboric acid is circulated through a leaching vessel to leach lead from the lead-bearing material and an electrolytic cell, for recovering lead from the solution. The process further comprises cooling at least a portion of the circulating solution sufficiently to precipitate alkali salts, and filtering the precipitated alkali salts from the solution.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a schematic diagram of a system, in accordance with a preferred embodiment of this invention.

Corresponding reference numerals indicate corresponding parts throughout the several views of the drawings.

DETAILED DESCRIPTION

Example embodiments will now be described more fully with reference to the accompanying drawings.

A preferred embodiment of an improved system for recovering lead from lead-bearing material is indicated generally as 20 in FIG. 1. As shown in FIG. 1, system 20 for carrying out the Flubor Process generally comprises a leaching vessel 22, a filter 24, and an electrolytic cell 26. A feed of lead-bearing material, such as a mineral concentrate containing galena (PbS), is provided to the leaching vessel 22. In the leaching vessel 22, there is a circulating acidic aqueous solution of ferric fluoroborate to form ferrous fluoroborate, lead fluoroborate, and elemental sulfur according to the reaction:

$$2Fe(BF_4)_3+PbS \rightarrow 2Fe(BF_4)_2+Pb(BF_4)_2+S$$

A slurry of the circulating solution and the remaining solid residue is transferred to filter 24, wherein the residue of composed elemental sulfur, other non-leachable minerals and gangue are removed. The solution of ferrous fluoroborate and lead fluoroborate circulates to a diaphragm electrolytic cell 26, where pure lead is deposited at the cathode of the electrolytic cell, while at the anode of the electrolytic cell ferrous ion is oxidized to ferric ion. The solution of ferric fluoroborate regenerated at the anode of the electrolytic cell 26, is transferred back to the leaching vessel 22, where it is reused in the leaching step. By operating under suitable conditions, lead can be selectively dissolved and separated from the other metals in the ore. Sulfur produced by the reaction can be separated from the residue from the filter 24 by extraction with a solvent, or by flotation.

The circulating solution is typically between about 50° and 100°, and preferably between about 70° C. and about 100° C. in the leaching vessel 22, to improve the leaching of lead from the lead-bearing materials. However, the circulating solution is preferably cooled to between about 30° C. and about 60° C., and more preferably to between about 35° C. and about 40° C. in the electrolytic cell 26 to improve the recovery of lead. However, the inventors have discovered that when certain ores are provided to the system 20, the continuous operation of the Flubor Process is interrupted by the sudden precipitation of solids from the circulating solution. These solids form on surfaces that are at a lower temperature than the circulating solution. These solids adhere strongly to surfaces, and are difficult to remove or even re-dissolve. It is believed that various organic substances (for example that are introduced in the conditioning of the lead ore or in the electrolytic cell), contribute to the adhesion of these precipitates and their resistance to dissolution. These solids quickly plug the smaller conduits in the system, such as those that feed the circulating solution to the electrolytic cells 26, and these solids also impair the recovery of lead metal from the solution at the cathode, not only interfering with the deposition of lead, but impairing the quality of the lead that is deposited.

In accordance with the principles of this invention, the system 20 is provided with an extraction system 28 for conditioning the circulating solution by removing impurities that build up as a result of the continuous operation of the system 20 with certain materials. The extraction system 28 includes a cooler 30, a filter 32, and a heater 34. The cooler 30 reduces the temperature of the circulating solution. Preferably the cooler reduces the temperature of the circulating solution by at least about 20°, and more preferably reduces the temperature of the circulating solution between about 25° C. and about 55° C. However the temperature of the solution is not reduced to below about 25° C. and more preferably not below about 30° C.

The extraction system 28 can wholly or partially replace the conventional heat exchanger used to cool the solution between the leaching vessel 22 and the electrolytic cell 26. A conventional heat exchanger used in conjunction with the extraction system 28 can provide more precise control over the temperature of the circulating solution. Where no supplemental heat exchanger is used the extraction system 28 must effect more of the temperature change between the preferred temperature in the leaching vessel 22 (for example, about 80° C.) and the preferred temperature in the electrolytic cell 26 (for example, about 45° C.), but where the supplemental heat exchanger is available, the extraction system 28 does not have to effect as great a temperature change. If the extraction system 28 is used with an auxiliary heat exchanger, it can be positioned upstream or downstream of the auxiliary heat exchanger. The extraction system 28 preferably cools the solution without contacting the solution, so that the precipitates form in the solution, and not at contact surfaces, where the precipitate can be difficult to remove.

In the preferred embodiment, this cooler is a vacuum crystallizer that evaporatively cools the solution by causing water to evaporate from the solution. A vacuum crystallizer uses the energy of the solution to remove water, reducing or avoiding the need to employ a boiler or other energy intensive methods of removing water. The removal of excess water is advantageous, because it helps maintain an adequate concentration of ferric fluoroborate in the circulating solution. This water is introduced into the system in various filtering (e.g., at 24 and 32) and washing steps (e.g., at 26). Surprisingly, it has been found that organic residues, from the processing of the lead-bearing material provided to the leaching vessel 22 and added as conditioners in the electrolytic cells, are also removed. The chilled solution from the cooler 30 passes to a filter 32, wherein precipitated solids (mostly alkali salts, such as potassium, sodium and other salts) are filtered from the solution. The solution is then reheated in heater 34, which is preferably a continuous flow heat exchanger. The heater preferably raises the temperature to between 30° C. to 55° C. appropriately for the electrolytic removal of lead. This reheating step retards further precipitation from the circulating solution.

The extraction system 28 is preferably positioned so that the circulating solution reaches its lowest temperature in the entire system at the cooler 30, and is preferably at least 2° C. lower, and more preferably at least 5° C. lower than the solution at any other location in the system. The extraction system is conveniently located just before the electrolytic cell 26. In the preferred embodiment, all of the circulating solution is provided to the extraction system 28, although in an alternate construction of the preferred embodiment, only a portion of the circulating solution is diverted through the extraction system 28.

The inventors have discovered that it is not necessary to remove one hundred percent to the accumulating alkali salts, and that operating the cooler to maintain a level of less than about 300 ppm potassium, and more preferably less than about 60 ppm potassium, and most preferably less than about 15 ppm potassium, is sufficient to retard the formation of undesirable precipitates in the system 20 or the interference with electrolytic of lead in the electrolytic cell 26. It is believed that if the levels of potassium are controlled, the levels of other alkali metal and alkali earth salts will likewise be controlled. The improved system 20 of the preferred embodiment, thus maintains the level of alkali salts in the system below the threshold, where they can precipitate out of the circulating solution and impair the operation of the system.

Particularly where a vacuum crystallizer is used, the system employs significantly less energy than other alternatives for removing the alkali salts, such as large cooling sumps or large cooling thickeners, which have a large footprint and require large volumes of circulating solution. In addition to removing the alkali salts, the vacuum crystallizer also removes excess water and organics from the solution which alternative methods of alkali salt removal do not. Because the system 20 is closed, it does not require a scrubber or other ventilation control, reducing energy consumption and maintenance.

Various alternative types of heat exchangers are impractical because of impurity build-up inside the exchangers and because they do not evaporate water or remove organics. The alkali salts and other impurities being removed have a very steep solubility curve and tend to stick to any surfaces cooler than the bulk solution. The organics, chiefly mill reagents, flocculating agents, and flotation suppressors, introduced in producing concentrates from ores can build-up and cause foaming and frothing in the leaching vessel 22, and in the electrolytic cells 26 where the problem is exacerbated by air sparging.

EXAMPLE

A pilot plant utilizing the Flubor Process for recovering lead from lead ore containing galena (PbS) was constructed and operated. A vacuum crystallizer was installed between the leaching vessel and the electrolytic cell to drop the temperature of the circulating fluid from between about 70° C. and about 100° C. by between about 20° C. and about 45° C., to a temperature of about 30° C. and about 55° C. The vacuum crystallizer chills the solution without contacting the solution with a cooler surface, which causes the precipitate to form in solution, rather than at a contact surface, which results in a very difficult to remove participate. The vacuum crystallizer removes accumulated water, increasing the concentration of iron fluoroborate in the circulating solution. This eliminates the need to try to evaporate water from the solution with bulk heating, which is energy intensive and time consuming because the temperature must be maintained sufficiently low to prevent the escape of HF from the solution. The vacuum crystallizer also removes at least some of the more volatile organic compounds (for example, that are introduced in the conditioning of lead mineral concentrate), which are believed to contribute to the adhesion of precipitates and their resistance to dissolution.

A volume of 20 liters of leaching solution at 80° C., 9070 ppm TOC (TOC is the total organic carbon, i.e., the amount of carbon bound in an organic compound) and 325 ppm potassium concentration was vacuum evaporated. The evaporator was operating at 0.035 bars and the temperature of the final liquid was 35° C. The test was completed when 4.5 liters of solution was evaporated. The resulting final solution was 15.2 liters having a TOC of 5650 ppm and 35 ppm potassium concentration. The precipitate recovered from the post vacuum crystallization filtration weighed 18.3 g.

The 4.5 liters of condensate had a distinct organic odor and a TOC concentration of 20300 ppm. This solution was treated with 100 g of activated carbon which resulted in a solution TOC concentration of 10 ppm. There was no smell in the final treated condensate solution.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. In a continuous system for recovering lead from lead-bearing materials in which an aqueous solution of ferric fluoroborate in fluoroboric acid is circulated through a leaching vessel in which lead is leached from the lead-bearing material and an electrolytic cell, in which lead is recovered from the solution, the improvement comprising:

a cooler for cooling at least a portion of the circulating solution sufficiently to precipitate alkali salts, and a filter for removing precipitated alkali salts from the solution.

2. The system according to claim 1 wherein the cooler is a vacuum crystallizer that cools the solution by evaporating water from the solution.

3. The system according to claim 2 wherein the entire flow of the circulating stream of solution passes through the vacuum crystallizer.

4. The system according to claim 2 wherein only a portion of the flow of the circulating stream of solution passes through the vacuum crystallizer.

5. The system according to claim 2 wherein the vacuum crystallizer cools the solution to the lowest temperature in the system.

6. The system according to claim 2 wherein the vacuum crystallizer reduces the temperature of the solution at least about 20° C.

7. The system according to claim 2 wherein the vacuum crystallizer reduces the temperature of the solution by between about 25° C. and about 55° C.

8. The system according to claim 2 wherein the cooling step comprises reducing the temperature of the solution to between about 35° C. and about 45° C.

9. The system according to claim 2 wherein the cooler and filter maintain the potassium salt level in the solution below about 300 ppm and all other alkali and alkali-earth salts below their saturation level.

10. The system according to claim 9 wherein the cooler and filter maintain the potassium level below about 30 ppm and all other alkali and alkali-earth salts below their saturation level.

11. The system according to claim 9 wherein the cooler and filter maintain the potassium level below about 15 ppm and all other alkali and alkali-earth salts below their saturation level.

12. The system according to claim 2, further comprising a heater for heating the solution after it is filtered.

13. In a continuous process for recovering lead from lead-bearing materials in which an aqueous solution of ferric fluoroborate in fluoroboric acid is circulated through a leaching vessel to leach lead from the lead-bearing material and an electrolytic cell for recovering lead from the solution, the improvement comprising:

cooling at least a portion of the circulating solution sufficiently to precipitate alkali salts, and a filter for removing precipitated alkali salts from the solution.

14. The process according to claim 13 wherein the solution is cooled by evaporating water from the solution in a vacuum crystallizer.

15. The process according to claim 14 wherein the entire circulating stream of solution is cooled.

16. The process according to claim 13 wherein only a portion of the circulating stream of solution is cooled.

17. The process according to claim 13 wherein the solution is cooled to its lowest temperature in the process prior to filtering.

18. The process according to claim 13 wherein the temperature of the solution is reduced by at least about 20° C.

19. The process according to claim 13 wherein the temperature of the solution is reduced by between about 25° C. and about 55° C.

20. The process according to claim 13 wherein the temperature of the solution is reduced to between about 35° C. and about 45° C.

21. The process according to claim 13, further comprising heating the solution after it is filtered.

22. The process according to claim 21 wherein the solution is heated at least 2° C. after filtration.

23. The process according to claim 22 wherein the solution is heated at least 5° C. after filtration.

24. The process according to claim 13 wherein the cooling and filtration maintain the potassium level in the solution below about 300 ppm and all other alkali and alkali-earth salts below their saturation level.

25. The process according to claim 13 wherein the cooling and filtration maintain the potassium level below about 30 ppm and all other alkali and alkali-earth salts below their saturation level.

26. The process according to claim 13 wherein the cooling and filtration maintain the potassium level below about 15 ppm and all other alkali and alkali-earth salts below their saturation level.

* * * * *